United States Patent [19]

Vegeby

[11] 4,049,489

[45] Sept. 20, 1977

[54] METHOD OF PRODUCING PULP AND BURNING WASTE LIQUOR OBTAINED THEREBY

[76] Inventor: Anders Vegeby, 1230 NW. 121st St., Seattle, Wash. 98177

[21] Appl. No.: 666,687

[22] Filed: Mar. 15, 1976

[30] Foreign Application Priority Data

Mar. 19, 1975 Sweden ..... 7503106

[51] Int. Cl.[2] ..... D21C 11/12; D21C 11/04

[52] U.S. Cl. ..... 162/30 R; 162/30 K; 162/DIG. 8; 423/207; 423/240; 423/495; 423/561 R; 423/DIG. 3

[58] Field of Search ..... 162/30 R, 30 K, DIG. 8; 423/207, 240, 495, 561, DIG. 3

[56] References Cited

U.S. PATENT DOCUMENTS

| | | | |
|---|---|---|---|
| 1,852,264 | 4/1932 | Rinman | 162/30 R |
| 1,906,102 | 4/1933 | Rinman | 162/30 R |
| 3,043,655 | 7/1962 | Green et al. | 162/30 R |
| 3,269,095 | 8/1966 | Brannlund | 162/30 R |
| 3,296,064 | 1/1967 | Cann | 162/30 R |
| 3,746,612 | 7/1973 | Rapson et al. | 162/DIG. 8 |
| 3,959,068 | 5/1976 | McIlroy et al. | 162/30 K |

*Primary Examiner*—S. Leon Bashore
*Assistant Examiner*—Peter F. Kratz
*Attorney, Agent, or Firm*—Cantor and Singer

[57] ABSTRACT

Environmental regulations tend to restrict the emissions from pulping platns, which increase the amount of sulphur and chlorine in the cooking liquor to undesirable amounts. This is detrimental to the process and increases the risk of corrosion upon the furnace walls. According to the invention certain metals, preferably iron and/or aluminum are burned together with the waste liquor, and will form compounds with the sulphur and the chlorine, respectively, which are easily separated from the chemicals taking part in the normal process cycle.

6 Claims, 1 Drawing Figure

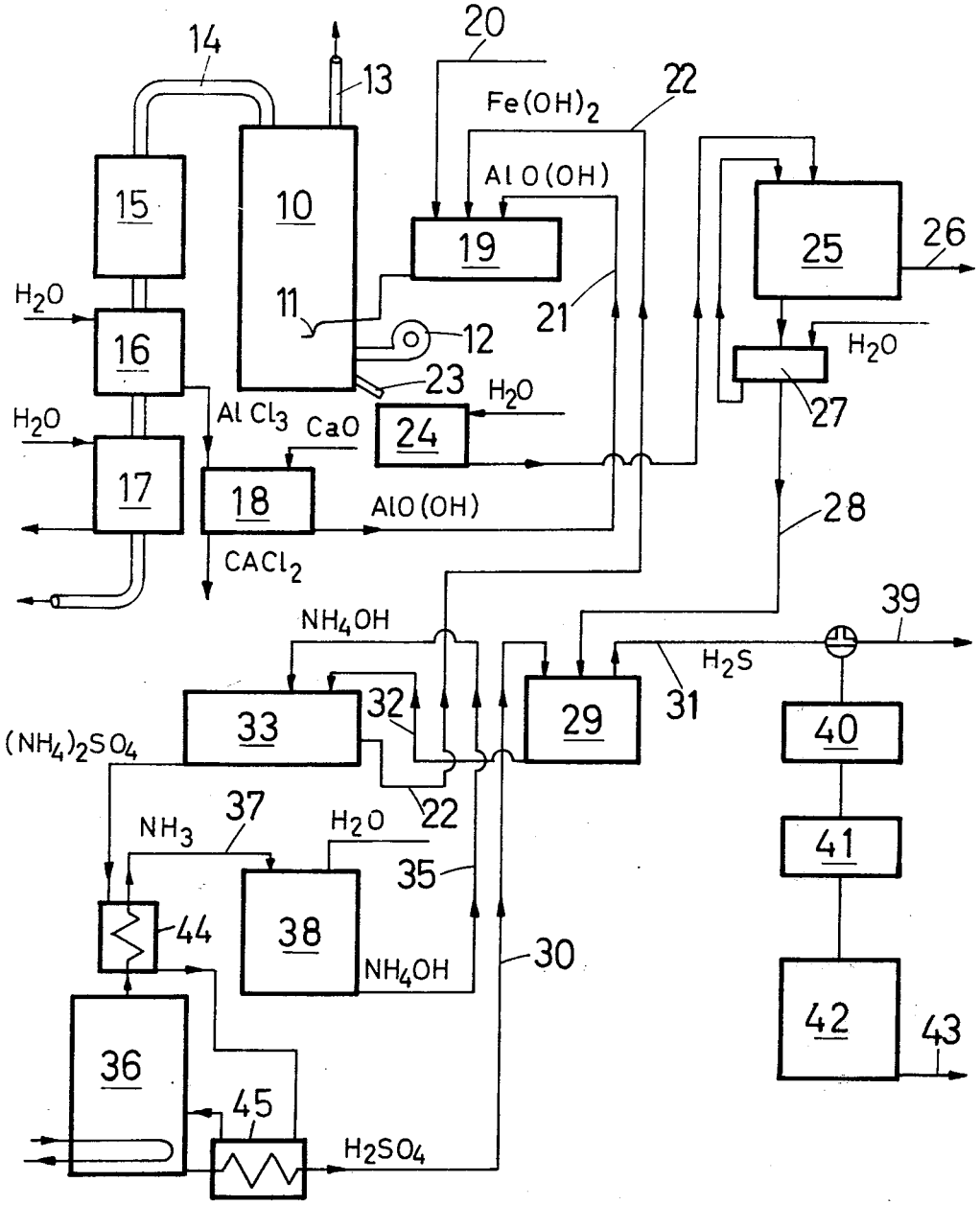
14
13
20
22
Fe(OH)2
AlO(OH)
15
10
19
25
26
H2O
11
21
16
12
H2O
23
H2O
27
H2O
AlCl3
CaO
24
17
18
AlO(OH)
28
CACl2
39
NH4OH
H2S
33
32
29
31
40
(NH4)2SO4
37
22
NH3
H2O
41
35
44
38
30
NH4OH
42
43
36
45
H2SO4

METHOD OF PRODUCING PULP AND BURNING WASTE LIQUOR OBTAINED THEREBY

BACKGROUND OF THE INVENTION

The recovery of heat and chemicals from the waste liquor obtained when producing cellulose pulp conventionally by cooking a cellulose feed stack in an aqueous liquor includes dehydrating the waste liquor to a comparatively high content of solids, usually above 60%, and then spraying the liquor into a furnace, where it is burnt in a reducing atmosphere in the lower part of the furnace. Additional air is supplied to the upper part of the furnace in order to bring about a complete combustion. A substantial part of the recovered chemicals are reclaimed in a molten state at the bottom of the furnace, but about 10% will leave the furnace together with the combustion gases, and are reclaimed after cooling of the gases. The reclaiming usually takes place in an electrostatic precipitator, and the recovered chemicals are returned to the process.

Due to environmental restrictions the losses of chemicals from the process must be carefully watched, which will bring about an undesirable increase of the content of sulphur and chlorine in the chemicals taking part in the process. The increase of chlorine is especially noticeable if waste fluid from the bleachery is concentrated and burnt in the furnace, or if the base material, or the chemicals added include chlorides. An increased amount of chlorides in the smelt will lower the melting point thereof, which means that the protecting cover of solidified chemicals upon the tube walls of the furnace will be thinner. This will increase the risk of corrosive attacks upon said tube walls.

An increase of the sulphur content may be caused by collecting and burning malodorous sulphurous gases, or if sulphuric acid residues from the preparation of chlorine-dioxide and from the pine oil plant are used to cover chemical losses in the process cycle. An increased sulphur content, i.e. an increased amount of sulphur as compared to the base of the process liquor, which usually is sodium, will cause an increased partial pressure of the sulphurous gases in the lower part of the furnace, and thereby an increased risk for corrosion. It is obviously desirable to reduce the partial pressure of the sulphurous gases in the combustion gases, as well as to reduce the content of chlorine in the smelt, especially in the deposits upon the walls of the furnace.

Summary of the Invention

The present invention refers to a method for modifying the operation of a pulp producing plant, so the disadvantages of an increased content of sulphur and/or chlorine may be reduced. This is obtained by introducing a metallic constituent into the furnace, together with or in parallel to the waste liquor, permitting said metallic constituent to react with chemical constituents in the waste liquor within the furnace to form at least one compound, and removing said at least one compound from the furnace and separating it from the circulatory process.

Theoretical background

Aluminum can, for instance, be added, preferably as the oxide or hydroxide which is stirred into the waste liquor. The aluminum will react with the chlorides and form the very volatile salt, aluminum chloride. This compound has a boiling point of 183° C at atmospheric pressure. A collection of this compound can therefore be avoided in the electrostatic precipitator if this is arranged in a place in thd flue gas path where the temperature is sufficiently high. The chemicals which are to be recovered can be collected with any desired collecting efficiency in the electrostatic precipitator. The aluminum chloride can be collected separately after further cooling of the flue gas by, for instance, scrubbing with water.

The aluminum chloride has a high solubility in water and a very high heat of solution. The water solution in the scrubber can therefore be kept at a temperature which is higher than the wet bulb temperature of the flue gas. Condensation of water and dilution of the solution can therefore be avoided. The aluminum chlorides can therefore be eliminated from the flue gas before the heat recovery for generation of hot water is made in the conventional way.

The aluminum can be recovered from the solution, for instance by electrolysis with simultaneous generation of chlorine, through ion exchangers or by a precipitation method, etc.

Addition of more aluminum than what is needed for the elimination of the chlorides from the chemicals in the process is probably undesirable, as the excess aluminum would form aluminum sulfides. These are decomposed if dissolved in a water solution (such as green liquor) and will generate hydrogen sulfide. The partial pressure of hydrogen sulfide over the green liquor surface would, in this case, increase even though the pH value of the green liquor is very high. An increase of the hydrogen sulfide partial pressure over the solution is probably not favourable with regard to the high poisonous effect of hydrogen sulfide.

To decrease the partial pressure of the sulfurous gases in the flue gas in the recovery boiler, another metal or compound may therefore be added to the waste liquor before injection into the furnace. The formed sulfides should preferably be insoluble in an alkaline water solution. Iron should, for instance, be suitable also from another point of view. Part of the iron in the waste liquor is emitted to the flue gases from the bed, probably as iron hydroxide, which has a relatively high partial pressure at the relevant temperatures of the process, and will condense on the tube wall surfaces. This emission of iron hydroxide is probably responsible for the relatively hgh content of iron which has been observed in the deposits on the tubes in the recovery boiler. If this iron content in the deposits was a corrosion product from the tube material itself, it would mean a very short lifetime of the recovery boiler.

The smelt layer on the tubes flows slowly downwards and the smelt from the recovery furnace walls will eventually be collected in the smelt layer at the bottom of the furnace and be discharged through the smelt spouts. All iron which has been injected into the boiler with the waste liquor will, therefore, eventually be found in the smelt and the green liquor, even though all the iron would emit from the surface of the bed to the flue gas. The very high iron content in the deposits on the tubes indicates that the emission of iron from the bed per unit of time is greater than the amount of iron per unit of time which with the present operation is charged to the boiler. There is evidently an internal circulation of iron within the recovery boiler through the emission to the flue gas and the return with the deposits on the tubes to the waste liquor.

It should, however, be possible to convey so much iron to the waste liquor that iron sulfides are formed in the bed to such an extent that the sodium-sulphur balance is changed. The amount of sulphur which combines with iron will reduce the amount of sulphur which is combining with sodium. The iron sulfides formed in the smelt are not soluble in the green liquor, which is an alkaline water solution, and can therefore be discharged from the main chemical stream by precipitation or separation. The amount of sodium sulfide in the green liquor will decrease and the amount of sodium carbonate will increase due to the fact that part of the sulphur combines with iron. This makes it possible to control the sulfidity of the green liquor and, consequently, also the sulfidity of the white liquor due to the fact that the corrosion hazard is decreased.

The iron sulfides which are formed can be washed to recover soluble alkali and can then be treated in a closed vessel — $H_2S$ stripper — with a suitable acid for generation of hydrogen sulfide. The hydrogen sulfide, which can be collected in the concentrated form, can be used either directly, for instance for hydrogen sulfide cooking, or can also be converted to elemental sulphur, for instance by the Claus process. The elemental sulphur can be used in several ways in the pulping process. It can be added to the white liquor to increase the content of polysulfides, for instance for polysulfide cooking, which will increase the pulping yield. It can also be burned with air for generation of sulphur dioxide which is used for the chlorine dioxide generation. It can also be stored and sold to consumers outside of the pulping process, as the amount of sulphur which is added to the process through the spent acids is higher in relation to sodium than what is wanted for the pulping process.

The spent acid from the generation of hydrogen sulfide from the iron sulfide is preferably recovered. Iron sulfate is formed if sulphuric acid is used for the generation of hydrogen sulfide from the iron sulfide. Iron hydroxide will be formed and precipitated if the solution is neutralized or made alkaline, for instance with ammonia. After precipitation of iron hydroxide the solution will contain ammonium sulfate which is not thermostable and will decompose at 160° C. It would therefore be suitable to increase the pressure of the solution to, for instance, 10 atmospheres and convey the solution to a distillation column. The ammonia will in this case be stripped from the solution at the top of the column and sulphuric acid will be discharged at the bottom of the column. The sulphuric acid can be reused for the stripping vessel for hydrogen sulfide and the ammonia can be absorbed in water and reused for the neutralization of the iron sulfate solution from the stripping vessel. The heat consumption for the distillation column can be decreased by using heat exchangers in the normal conventional arrangement.

Other metals or compounds that aluminum or iron can be used if they form compounds which are volatile or insoluble in water with chlorides or sulphur. The mentioned metals, aluminum and iron, are chosen as examples because they are commonly available and therefore inexpensive in use.

BRIEF DESCRIPTION OF THE DRAWING

The single drawing schematically shows a plant for the combustion of waste liquor from cellulose pulp manufacture.

BRIEF DESCRIPTION OF A PREFERRED EMBODIMENT

A furnace forming part of a steam boiler is denoted by 10. The dehydrated waste liquor, to which aluminum hydroxide and iron hydroxide have been added in a manner to be described below in sprayed into the furnace by means of one or more nozzles 11 and are burnt by means of air which is supplied by a fan 12. Stream is withdrawn by a pipe 13, and in the smoke gas flue 14 from the furnace there is an electric precipitator 15, a scrubber 16 and a heat exchanger 17. An air preheater and other heat exchangers (not shown) may, as usual, be fitted in the smoke gas flue.

Electric precipitators are well known in the art. A substantial part of the chemicals being carried away from the furnace by the combustion gases will be recovered in such a precipitator, and may be returned to the process cycle in any suitable manner.

On the present occasion it is essential that the temperature in the electric precipitator shall be kept so high (above 183° C), that no aluminum chloride is precipitated.

The aluminum chloride is recovered in scrubber 16 by means of water, which in a well known manner is sprayed into the combustion gases. Aluminum chloride has a high solubility and a high content of heat of solution so the temperature in the scrubber may easily be maintained above the dew point of the combustion gases.

Heat exchanger 17, which may be a second scrubber, is used for producing hot water, which is needed within the process cycle.

The dissolved aluminum chloride is conveyed from scrubber 16 to a settling tank 18, where slaked lime, CaO, is added. In this manner calcium chloride, $CaCl_2$, is obtained, which may be further treated in order to recover chlorine. Aluminum hydroxide, AlO(OH) is also obtained and is of immediate interest for the process.

The liquor forwarded to the injection nozzles 11 will contain waste liquor from the cooking operation and dehydrated to a suitable content of solids. The dehydrated waste liquor is delivered to a mixing tank 19 by way of a conduit 20. The AlO(OH) solution obtained in settling tank 18 is conveyed to the mixing tank by way of a conduit 21. Furthermore, iron hydroxide, $Fe(OH)_2$ is also supplied to the mixing tank by way of a further conduit 22. Other combustible waste liquor from other parts of the pulping plant may also be conveyed to the mixing tank.

As a result of the combustion within furnace 10 a residue of molten chemicals is collected at the bottom of the furnace and is withdrawn by way of a spout 23 to a dissolving tank 24. The solution obtained in this tank is transferred to a green liquor clarifier 25 and from the latter green liquor is withdrawn by way of a conduit 26 for further treatment.

The smelt will contain iron sulfide, which is insoluble in the green liquor, and this sulfide forms the main deposit in clarifier 25. The deposits are brought through a washing filter 27, from which water-soluble alkali is returned to clarifier 25. The remainder of the deposits is conveyed to a closed vessel 29 by way of conduit 28. In this vessel hydrogen sulfide, $H_2S$, is generated by means of sulphuric acid, which is supplied by way of conduit 30.

The hydrogen sulfide is removed by means of a conduit 31 for further treatment, and the residue is, by way of a conduit 32, transferred to a precipitation vessel 33, to which a base, on this occasion $NH_4OH$, is added by way of a conduit 35.

In the precipitation vessel iron hydroxide, which by way of conduit 22, previously mentioned, is conveyed to mixing tank 19, as well as ammonium sulfate, $(NH_4)_2SO_4$, are obtained. The latter is not thermostable, and is transferred to a distillation column 36, where it is subjected to a pressure of 10 atmospheres and to a temperature of 160° C, which causes a decomposition of said sulfate into ammonia and sulphuric acid.

The latter is conveyed to the $H_2S$ stripper 29, while the gaseous ammonia by way of a conduit 37 is conveyed to an absorption tower 38. By adding water to the $NH_4OH$ — solution, which by way of conduit 35 is led to prcipitation vessel 33, will be obtained.

Heat exchangers 44 and 45, respectively, are arranged in connection to the distillation column and will reclaim heat from the ammonia and the sulphuric acid, respectively, removed from the column.

The hydrogen sulfide formed in vessel 29, may either be used directly in the process, and is then led away by a conduit 39, or may be transferred to a so called Claus-reactor 40. Elementary sulphur is then precipitated in a cooler 41 and is transferred to a storage bin 42. Sulphur may be withdrawn from this bin by way of a conduit 43 for the preparation of cooking white liquor, as called for by the need of the process cycle.

The improvement, of the invention is thus that at least one, preferably two metal constituents, which do not normally take part in the cooking process are added to the burning waste liquor. These constituents may be added somewhere just upstream of the furnace, or may be introduced separately thereinto, in parallel to the waste liquor. Other metals than aluminum and iron may be used, the essential point is that they shall be capable of reacting with chlorine, or sulphur, respectively, and to bind these into compounds, which are reclaimable from the combustion gases, or from the dissolved smelt, easily separable from the chemicals circulating in the process. These compounds furthermore shall be of a nature to permit reclaiming and re-use of the metal constituents.

It may be desirable to reduce the chlorine content completely, or in any case to below 0.5% as counted upon the content of dry substance. The sulphur content, which normally is about 3%, but which on occasions can rise to 6%, may advantageously be reduced to below 3%, preferably to 2%.

What I claim is:

1. In a process for producing pulp, in which a cellulose feed stock is cooked in an aqueous liquor containing sulphur, and the resulting waste liquor is burnt in a furnace in order to recover chemicals which are used for preparing cooking liquor to be recycled in the process, the steps of:

a. introducing an iron compound into the furnace, together with, or in parallel to the waste liquor;

b. reacting said iron compound within the furnace with the sulphur constituent in the burning waste liquor to form a smelt containing an insoluble iron sulphide;

c. removing said smelt from the furnace and dissolving said smelt in an aqueous solution to form a weak liquor for recycling in the process;

d. separating said insoluble sulphide from said solution;

e. reacting said separated iron sulfide with sulphuric acid to produce $FeSO_4$ and $H_2S$, and separating said $FeSO_4$ and $H_2S$; and reacting the $FeSO_4$ with $NH_4OH$ to obtain ammonium sulfate, $(NH_4)_2SO_4$, and iron hydroxide, $Fe(OH)_2$, and recycling the latter as the iron compound to be introduced into the furnace.

2. The method process according to claim 1, including the further step of reacting the ammonium sulfate in a distillation column under elevated pressure and temperature to cause a decomposition thereof into ammonia and sulphuric acid, and using this acid for reacting with the iron sulfide separated from the recycling process.

3. In a process for producing pulp, in which a cellulose feed stock is cooked in an aqueous liquor containing chlorine, and the resulting waste liquor is burnt in a furnace in order to recover chemicals which are used for preparing cooking liquor to be recycled in the process, the steps of:

a. introducing an aluminum compound into the furnace together with, or in parallel to the waste liquor;

b. reacting said aluminum compound within the furnace with the chlorine constituent of the burning waste liquor to form combustion gases carrying returnable process chemicals and aluminum chloride, said aluminum chloride being volatile at the elevated temperature prevailing in the furnace;

c. removing said combustion gases from the furnace and separating off said returnable process chemicals from the combustion gases while the same still are at an elevated temperature; and thereafter d. removing said aluminum chloride from the combustion gases at a lower temperature.

4. The process according to claim 3, including removing the aluminum chloride from the combustion gases by scrubbing with water, reacting the resulting aqueous solution with slaked lime to obtain calcium chloride and aluminum hydroxide separating said calcium chloride and recycling the aluminum hydroxide as the aluminum constituent for introduction into the furnace.

5. In a process for producing pulp in which a cellulose feed stock is cooked in an aqueous liquor containing sulphur and chlorine, and the resulting waste liquor is burnt in a furnace in order to recover chemicals which are used for preparing cooking liquor to be recycled in the process, the steps of:

a. introducing an iron compound and an aluminum compound into the furnace together with, or in parallel to the waste liquor;

b. reacting said iron compound with the sulphur constituent in the burning waste liquor, and said aluminum compound with the chlorine constituent of the burning waste liquor, within the furnace to form a smelt containing an insoluble iron sulphide and combustion gases carrying returnable process chemicals and aluminum chloride, respectively, said aluminum chloride being volatile at the elevated temperature prevailing in the furnace;

c. removing said smelt from the furnace and dissolving said smelt in an aqueous solution to form a weak liquor for recycling in the process;

d. separating said insoluble sulphide from said solution;

e. removing said combustion gases from the furnace and separating off said returnable process chemicals from the combustion gases while the same still are at an elevated temperature; and thereafter f. removing said aluminum chloride from the combustion gases at a lower temperature.

6. The process according to claim 5, wherein said iron compound is $Fe(OH)_2$, said aluminum compound is AlO(OH), and said iron and aluminum compounds are mixed with said waste liquor prior to introduction into said furnace.

* * * * *